US009243629B1

(12) United States Patent
Zelechonok

(10) Patent No.: US 9,243,629 B1
(45) Date of Patent: Jan. 26, 2016

(54) HIGH PRESSURE LIQUID CHROMATOGRAPHY PUMP

(71) Applicant: Yury Zelechonok, Northbrook, IL (US)

(72) Inventor: Yury Zelechonok, Northbrook, IL (US)

(73) Assignee: SIELC Technologies Corporation, Wheeling, IL (US)

( * ) Notice: Subject to any disclaimer, the term of this patent is extended or adjusted under 35 U.S.C. 154(b) by 353 days.

(21) Appl. No.: 13/837,903

(22) Filed: Mar. 15, 2013

(51) Int. Cl.
*F04B 53/00* (2006.01)
*F04B 35/04* (2006.01)

(52) U.S. Cl.
CPC ..... *F04B 53/006* (2013.01); *F04B 35/04* (2013.01)

(58) Field of Classification Search
CPC ..... A61M 5/14228; A61M 2205/128; A61M 2205/14; A61M 5/142; F04B 43/082; F04B 11/0058; F04B 11/0066; F04B 11/0083; F04B 13/02; F04B 1/12; F04B 2205/09; F04B 23/06; F04B 37/12; F04B 43/08; F04B 43/123; F04B 53/06; F04B 53/164; F04B 9/042; B01D 15/14; F16H 53/06; G01N 2030/326
USPC ..... 417/415
See application file for complete search history.

(56) References Cited

U.S. PATENT DOCUMENTS

| | | | | |
|---|---|---|---|---|
| 3,917,531 | A * | 11/1975 | Magnussen | 210/101 |
| 4,753,581 | A | 6/1988 | Hiscock | |
| 5,357,827 | A | 10/1994 | Natwick et al. | |
| 5,653,876 | A | 8/1997 | Funke | |
| 6,267,559 | B1 | 7/2001 | Mossman et al. | |
| 7,063,785 | B2 | 6/2006 | Hiraku et al. | |
| 2011/0231076 | A1 * | 9/2011 | Watanabe et al. | 701/70 |

* cited by examiner

*Primary Examiner* — Nathan J Newhouse
*Assistant Examiner* — Thomas R Cash
(74) *Attorney, Agent, or Firm* — John C. Shepard

(57) ABSTRACT

A pump for use in high pressure liquid chromatography includes a housing with a pump head at one end and an axially-movable, high-pressure piston with a small-diameter plunger reciprocating within the pump head to move fluid from an inlet through an outlet at high pressure. An attached motor rotates a circular cam fixed off center on the motor shaft to reciprocate the piston that has an inner end in engaging contact with the cam periphery. An axially-aligned, torque-compensating piston is provided and has an inner end biased by spring force against the cam opposite the high-pressure piston. A large-diameter piston head may be fixed to the outer end of the torque-compensating piston and slidably mounted within a cylinder defined at the housing end opposite the pump head. The outer end of the piston head is open to ambient atmosphere.

19 Claims, 3 Drawing Sheets

HIGH PRESSURE LIQUID CHROMATOGRAPHY PUMP

BACKGROUND OF THE INVENTION

1. Technical Field

The present invention relates to pumps and, more particularly, high pressure liquid chromatography pumps.

2. Background of the Invention

In high pressure liquid chromatography ("HPLC") systems, specialized pumps are used to produce fluid pressures in the range of 5000 to 6000 psi, or even more. Typically, the pumps are piston type pumps that employ pressure chambers having an upstream inlet with a non-return check valve and a downstream outlet with a non-return check valve. The pump piston is reciprocated by means of a rotating cam in engaging relation with one end of the piston. The other end of the piston has a plunger made of highly polished sapphire or ruby that has a diameter of 1 to 10 millimeters (0.04 to 0.4 inch) and is slidably held within the pump housing by suitable bearings and seals.

Since the pressure in HPLC systems must be carefully monitored to maintain a consistent flow rate, the cam is rotatively driven by way of an electronically-activated stepper or servo motor. As with any electrically-operated device, including stepper and servo motors, the motor torque requirements should be minimal so that smaller, less expensive motors may be used. One method of minimizing torque requirements is to use torque compensation. Examples of torque compensation are shown in Natwick et al U.S. Pat. No. 5,357,827 issued Oct. 25, 1994 and in Mossman et al. U.S. Pat. No. 6,267,559 issued Jul. 31, 2001. Therein, attempts were made to maintain and compensate motor load at a more constant level, since load pulsations require that a motor be used with torque capacity higher than maximum possible torque.

Several issues of concern are present in prior art constructions. First, the pumps often have overly complex configurations or constructions. Second, the stepper motors previously used had enough torque capacity to operate at maximum required torque but any excessive torque was not utilized for other purposes when torque peak was not present. Third, in the case of HPLC pumps, less that half of the rotational cycle requires high torque operation, while the rest of the cycle uses very little torque, if any.

While the prior art devices are generally sufficient for their intended function, other constructions may provide features that may be more desirable to the user.

BRIEF SUMMARY OF THE INVENTION

The present invention is directed to overcoming one or more of the problems as set forth above.

It is an object of the present invention to provide an HPLC pump that effectively reduces power consumption, has few manufacturing complexities, minimizes the number of components, and is relatively inexpensive.

In one aspect of the invention, a high-pressure pump includes a first piston having at one end a plunger in working relationship with a pump head to move fluid at high pressure therethrough and engaging at its opposite end a motor-driven cam that axially reciprocates the piston and further includes a second piston engaging the opposite side of the cam providing compensating torque.

In another aspect of the invention, the pistons are axially aligned and the cam has a circular piston-engaging peripheral edge and is mounted off center relative to the axis of the motor shaft.

One feature of the present invention is that the torque-compensating piston is biased against the cam by a spring with the spring being selected to provide a biasing force approximately equivalent to one half of the maximum force applied to the cam by the high-pressure piston, or approximately the average applied force.

In one embodiment of the invention, the torque-compensating piston includes a coiled compression spring positioned between an annular shoulder of the torque-compensating piston and the end wall of the pump case.

In a second embodiment of the invention, an additional pump structure is incorporated and includes a cylinder defined at the housing end opposite the high-pressure pump head and a piston head reciprocatable within the cylinder and mounted at an outer end of the torque-compensating piston. The additional pump creates additional force on the cam and also provides a mechanism for pumping air to create a vacuum useful in HPLC applications techniques or for pumping a second fluid.

A feature of the second embodiment is that the piston head has a diameter substantially greater than the working diameter of the plunger and ambient atmospheric pressure acts on the outer end surface of the piston whereby pumping is assisted by air pressure and the required force of the compensating spring force is reduced.

A further feature of the second embodiment is that the cylinder may be formed integrally with the pump housing and its associated inlet and outlet may be defined in the end wall of the pump housing.

BRIEF DESCRIPTION OF THE SEVERAL VIEWS OF THE DRAWINGS

The details of construction and operation of the invention are more fully described with reference to the accompanying drawings which form a part hereof and in which like reference numerals refer to like parts throughout.

In the drawings.

Figure 1:
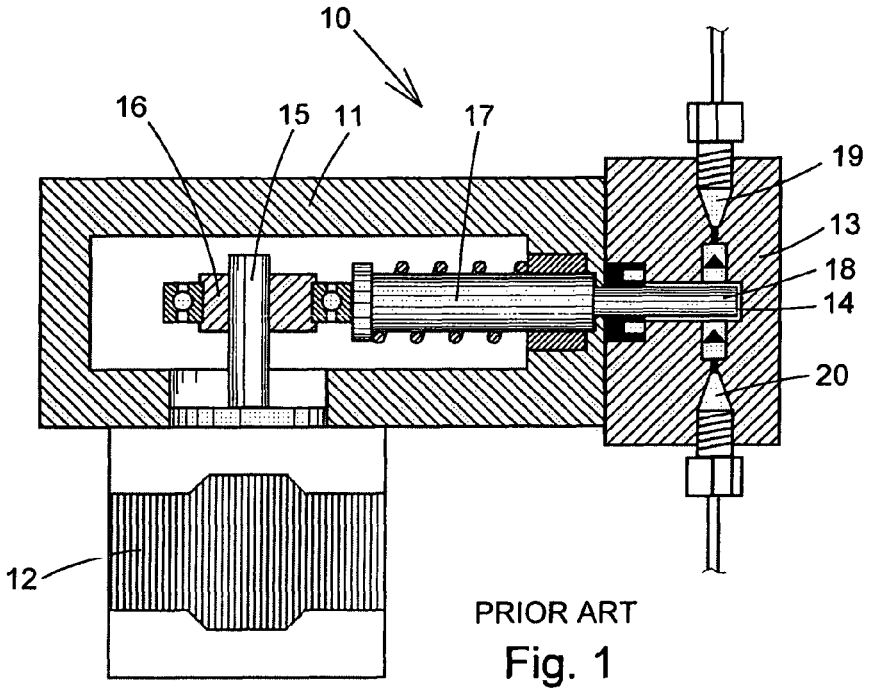
PRIOR ART Fig. 1
FIG. 1 is a cross-sectional view of a prior art high pressure liquid chromatography pump.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood.

DETAILED DESCRIPTION OF THE PREFERRED EMBODIMENTS

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Referring to FIG. 1, a prior art pump, generally designated 10, used in high pressure liquid chromatography is shown. The pump 10 has a housing 11, a motor 12 attached to the housing 11, and a pump head 13 fixed at one end of the housing 11 defining a pump pressure chamber 14. The motor shaft 15 rotates an eccentric cam 16 that engages a piston 17 to move a small-diameter plunger 18 reciprocatively in the pump chamber 14 so that fluid is drawn from an inlet 19 and forced through an outlet 20 at high pressure.

Figure 2:
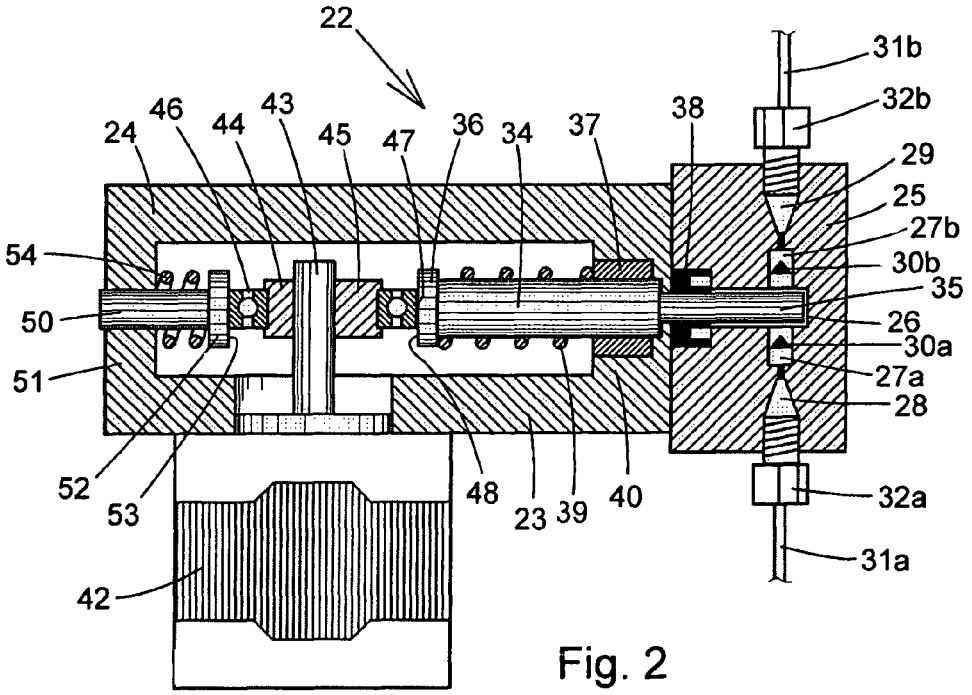
FIG. 2 is a cross-sectional view of a high pressure liquid chromatography pump constructed in accordance with the present invention.

Referring to FIG. 2, one embodiment of a fluid pump, generally designated 22, constructed in accordance with the present invention is shown. The pump 22 includes a housing 23 having a drive case 24 with a pump head 25 fixed to one end. The pump head 25 defines an internal cylindrical pump pressure chamber 26 and fluid flow paths 27*a*,27*b* providing respective fluid communication with an upstream inlet 28 and a downstream outlet 29. A non-return check valve 30*a* is positioned in the upstream flow path 27*a* between the pump chamber 26 and the inlet 28 preventing backflow of fluid from the pump chamber 26 to the inlet 28. Similarly, a non-return check valve 30*b* is positioned in the downstream flow path 27*b* between the pump chamber 26 and the outlet 29 preventing backflow of fluid from the outlet 29 into the pump chamber 26. Inlet and outlet tubes 31*a*,31*b* are respectively attached to the inlet 28 and outlet 29 by suitable fittings or connectors 32*a*,32*b*.

A high-pressure piston 34 is disposed within the housing 23 and includes a relatively small diameter, cylindrical plunger 35 at one end extending from the case 24 into the pump head 25 and an inner end having an external annular shoulder 36. The piston 34 is reciprocatable along a longitudinal slide axis so that the plunger 35 may be moved into and out of the pump chamber 26. The piston 34 is supported by a bearing or sleeve 37 carried by the case 24 and a high-pressure seal 38 carried by the pump head 25 preventing fluid leakage from the pump chamber 26. A spiral return spring, such as coiled compression spring 39, surrounding the piston 34 and extending between the piston shoulder 36 and the housing end 40 biases the piston 34 inwardly. Here, only a relatively small spring force is required, typically, only 3 to 5 pounds of force.

A stepper motor 42 is attached to the case 24 and has a shaft 43 extending into the case 24 along a transverse rotational axis that intersects and is perpendicular to the piston axis. The motor 42 rotates a disc-shaped cam 44 within the case 24 that is fixed at one end of the shaft 43. The cam 44 includes a cam body 45 and a circular bearing 46, the circumferential edge of which defines the outer circular peripheral edge 47 of the cam 44. The inner race of the bearing 46 is press fit around the cam body 45. The cam peripheral edge 47 extends through the longitudinal axis with the axis passing through the cam edge 47 at opposite sides of the cam 44.

The cam 44 has a geometric center that is radially offset relative to the shaft rotational axis causing the cam outer edge 47 to travel eccentrically. The flat inner end 48 of the piston 34 is held in sliding contact with the outer race of the bearing 46 by the return spring 39. Since the piston 34 is maintained in engagement with the eccentrically moving cam peripheral edge 47, the piston 34 is caused to reciprocate along the longitudinal axis thereby drawing fluid from a source through the inlet 28 and forcing it out through the outlet 29.

A torque-compensating piston 50 is provided in the case 24 axially opposite the high-pressure piston 34 with the cam 44 thereby residing between the inner ends of the respective pistons 34,50. The piston 50 is supported at its outer end by the end wall 51 of the case 24 and has an external annular shoulder 52 at its inner end so that its flat inner end surface 53 is biased for tangential contact with the cam peripheral edge 47 by a return spring 54 acting between the shoulder 52 and the housing wall 51. Since it is difficult or nearly impossible to make a spring providing an adjustable force, the torque-compensating spring should generate a force that is approximately equivalent to one half of the maximum force applied to the cam by the high-pressure piston, or the average of the applied force.

Figure 5A:
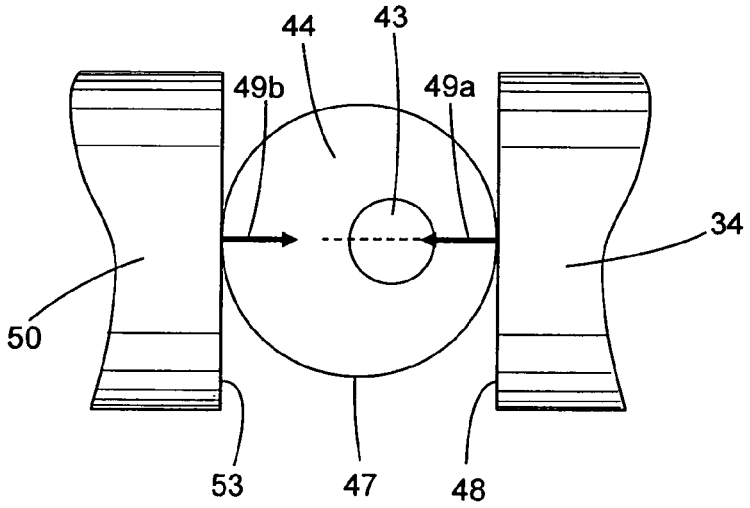
FIG. 5*a* is a fragmentary top schematic view of the pump cam in a first position.
Figure 5B:
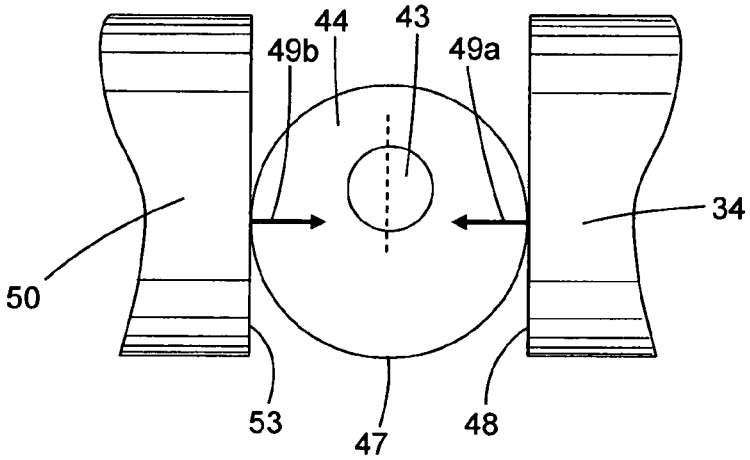
FIG. 5*b* is a fragmentary top schematic view of the pump cam in a second position rotated 90° counterclockwise from the position shown in FIG. 5*a*; and, FIG. 5*c* is a fragmentary top schematic view of the pump cam in a third position rotated 45° counterclockwise from the position shown in FIG. 5*b*.
Figure 5C:
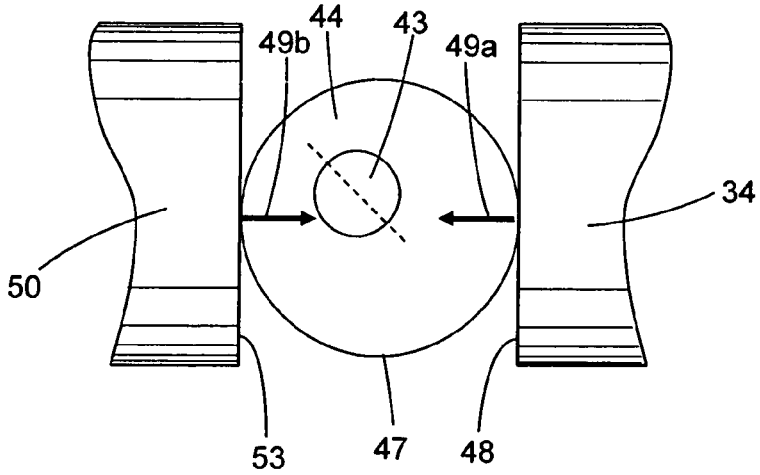

As seen schematically in FIGS. 5*a*-5*c*, rotation of the shaft 43 rotates the cam 44 fixed thereto. Because the cam 44 is mounted eccentrically to the axis of the shaft 43, the pistons 34,50 will be simultaneously and alternately moved in opposite directions. When the cam 44 is in the rotational position as seen in FIG. 5*a*, the plunger of piston 34 has moved longitudinally inwards to a retracted position within the pump chamber drawing fluid, or in the case of HPLC, mobile phase or solvent, into the pump chamber with the spring forcing the compensating piston 50 inward against the cam 44. In this position, the points of contact of the two pistons 34,50 are aligned on the longitudinal sliding axis, which passes through the shaft rotational axis.

When the cam 44 is in the rotational position shown in FIG. 5*b*, the piston 34 has moved longitudinally outward from its retracted position, the spring continuing to force the compensating piston 50 against the cam 44 with the same force. When the cam 44 is in the rotational position shown in FIG. 5*c*, the plunger of piston 34 is nearly fully extended into the pump chamber with pressure nearing maximum, the spring continuing to force the compensating piston 50 against the cam with the same force. The arrows 49*a*,49*b* indicate the direction of forces that are being applied to the cam periphery 47 by each of the pistons 34,50 at their points of contact, the position of the points of contact varying relative to the shaft center as the cam 44 rotates, but remaining directly opposed to each other.

Figure 3:
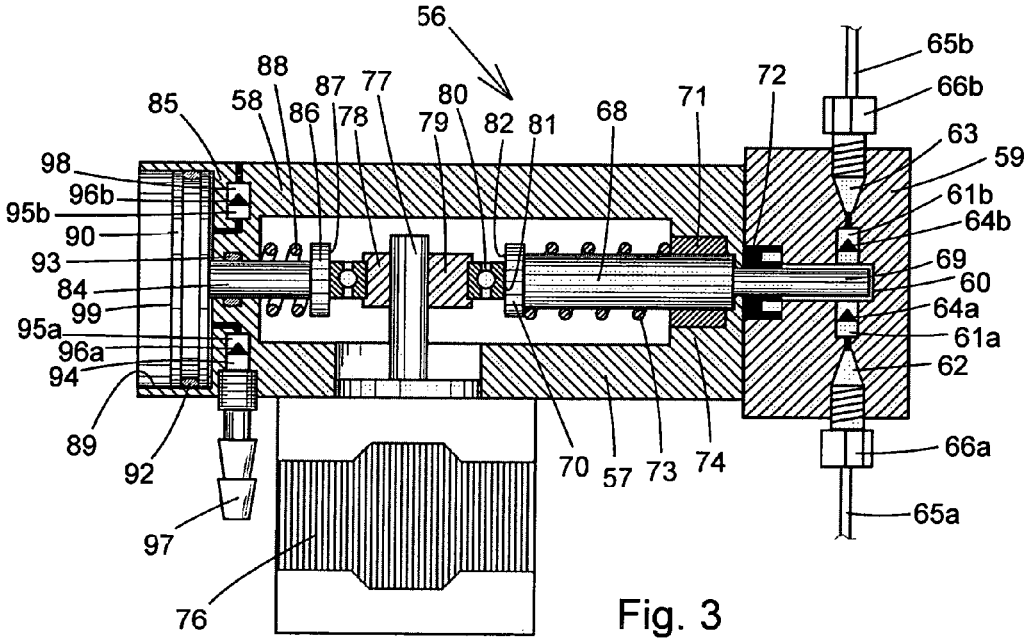
FIG. 3 is a cross-sectional view of a second embodiment of a high pressure liquid chromatography pump constructed in accordance with the present invention showing the piston plunger in an extended pumping position relative to the pump pressure chamber.
Figure 4:
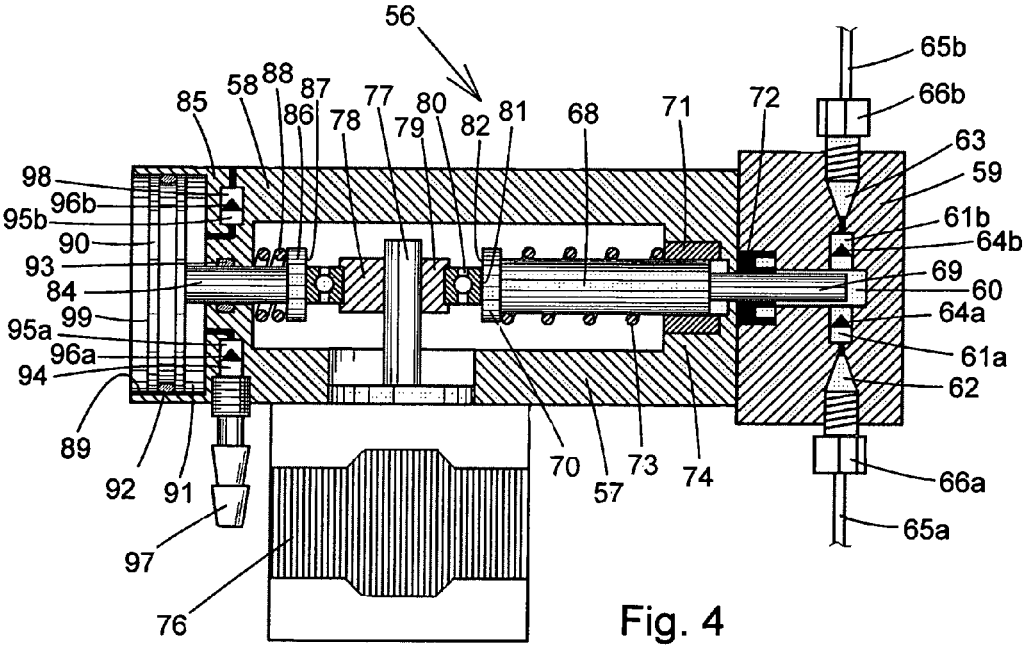
FIG. 4 is a cross-sectional view of the high pressure liquid chromatography pump shown in FIG. 3 showing the cam rotated 180° with the piston plunger in a withdrawn fill position relative to the pump pressure chamber.

Another embodiment of a pump, generally designated 56, constructed in accordance with the present invention is shown in FIGS. 3 and 4. The pump 56 includes a housing 57 having a drive case 58 with a pump head 59 fixed to one end. The pump head 59 defines an internal cylindrical pump pressure chamber 60 and fluid flow paths 61*a*,61*b* providing respective fluid communication with an upstream inlet 62 and a downstream outlet 63. A non-return check valve 64*a* is positioned in the upstream flow path 61*a* between pump chamber 60 and the inlet 62 preventing backflow of fluid from the pump chamber 60 to the inlet 62. Similarly, a non-return check valve 64*b* is positioned in the downstream flow path 61*b* between pump chamber 60 and the outlet 63 preventing backflow of fluid from the outlet 63 into the pump chamber 60. Inlet and outlet tubes 65*a*,65*b* are respectively attached to the inlet 62 and outlet 63 by suitable fittings or connectors 66*a*,66*b*.

A high-pressure piston 68 is disposed within the housing 57 and includes a relatively small diameter, cylindrical plunger 69 at one end extending from the case 58 into the pump head 59 and an inner end having an external annular shoulder 70. The piston 68 is reciprocatable along a longitudinal axis so that the plunger 69 may be moved into and out of the pump chamber 60. The piston 68 is supported by a bearing or sleeve 71 carried by the case 58 and a high-pressure seal 72 carried by the pump head 59 preventing fluid leakage from the pump chamber 60. A spiral return spring, such as coiled compression spring 73, surrounding the piston 68 and extending between the piston shoulder 70 and the housing end 74 biases the piston 68 inwardly.

A stepper motor 76 is attached to the case 58 and has a shaft 77 extending into the case 58 along a transverse rotational axis that intersects and is perpendicular to the piston axis. The motor 76 rotates a disc-shaped cam 78 within the case 58 that is fixed at one end of the shaft 77. The cam 78 includes a cam body 79 and a circular bearing 80, the circumferential edge of which defines the outer circular peripheral edge 81 of the cam 78. The inner race of the bearing 80 is press fit around the cam body 79. The cam peripheral edge 81 extends through the longitudinal axis with the axis passing through the cam edge 81 at opposite sides of the cam 78.

The cam 78 has a geometric center that is radially offset relative to the shaft rotational axis causing the cam outer edge 81 to travel eccentrically. The flat inner end 82 of the piston 68 is held in sliding contact with the outer race of the bearing 80 by the return spring 73. Since the piston 68 is maintained in engagement with the eccentrically moving cam peripheral edge 81, the piston 68 is caused to reciprocate along the longitudinal axis thereby drawing fluid from a source through the inlet 62 and forcing it out through the outlet 63.

A torque-compensating piston 84 is provided in the case 58 axially opposite the high-pressure piston 68 with the cam 78 thereby residing between the inner ends of the respective pistons. The piston 84 is supported at its outer end by the end wall 85 of the case 58 and has an external annular shoulder 86 at its inner end so that its flat inner end surface 87 is biased for tangential contact with the cam peripheral edge 81 by a return spring 88 acting between the shoulder 86 and the housing wall 85.

Herein, the end of the housing 57 opposite the pump head 59 defines an integral cylinder 89 with the housing end wall 85 defining the bottom wall of the cylinder 89. It is understood that the cylinder 89 may be formed separately and fixed to the housing end. At the outer end of the compensating piston 68 is a relatively large diameter piston head 90 that reciprocates within the cylinder 89 and defines a pump vacuum chamber 91 therewith. To prevent leakage, annular seals 92 and 93 are respectively provided in a peripheral groove of the piston head 90 and in the housing end wall 85. An inlet 94 formed at one side of the end wall 85 and extending to the housing periphery defines an upstream air flow path 95*a* to the pump chamber 91 and includes an embedded non-return check valve 96*a*. A barbed fitting 97 adapted to receive a tube is shown threaded into the inlet 94. An outlet 98 formed at the other side of the end wall 85 and extending to the opposite side of the housing periphery defines a downstream air flow path 95*b* from the pump chamber 91 and includes an embedded non-return check valve 96*b*.

FIG. 3 shows the cam 78 in one position with the piston 68 extended and the plunger 69 pumping fluid from the outlet 63, while FIG. 4 shows the cam 78 rotated with the piston 68 retracted and the plunger 69 drawing fluid from the inlet 62. At the other end of the housing 57, reciprocation of the piston head 90 draws gas or other fluid from the inlet 94 and forces it from the outlet 98. This side of the pump can be used as a vacuum pump to draw air or gas from the inlet 94 and expel it from the outlet 98 which can be open to ambient atmosphere, eliminating the need in HPLC applications for a separate vacuum pump and its associated motor and controller. This side of the pump can also be used to pump other fluids or liquids.

The plunger 69 of the piston 68 usually has an axial stroke between 0.05 and 0.25 inch and a diameter of less than 0.4 inch, typically 0.125 inch. The atmospheric piston head 90 has a diameter 10 to 15 times the diameter of the plunger 69.

By way of specific example, with the high pressure plunger 69 having a diameter in the neighborhood of 0.125 inch, at 5000 psi about 61 pounds of force is generated against the end of the plunger 69 during compression. However, over a complete cycle, it can vary between 0 and 61 pounds or higher. The return spring 73 provides a force of about 3 to 5 pounds to bias the piston 68 against the cam bearing edge 81. In the embodiment of the pump shown in FIG. 2, the torque-compensating spring 54 should therefore generate 30 to 40 pounds of force, which is approximately the average force generated during a pump cycle, or one half of the maximum force.

In the embodiment of the pump shown in FIGS. 3 and 4, the compensating piston 84 has a flat external end surface 99 open to ambient atmosphere. When the piston head 90 is pumping air to create a vacuum, the torque-compensating spring 88 need only provide a 3- to 5-pound force to bias the piston 84 against the cam bearing edge 81, approximately the force applied by the return spring 73. This biasing force of spring 88 is required during the pump's initial start-up cycles. The rest of the required force results from air pressure acting on the end surface 99 of the piston head 90. Assuming normal air pressure is about 14.7 psi and a piston head diameter in the neighborhood of 1.5 inches, approximately 26 pounds of force is exerted by atmospheric pressure on the outer external end 99 of the piston head 90. Once the pump is operating, the vacuum on the internal side results in significant differential pressure tending to move the compensating piston 84 inward. In contrast, when the piston head 90 is moving liquids, the torque-compensating spring 88 should be selected to provide a force of 30 to 40 pounds, similar to the spring 54 employed in the embodiment shown in FIG. 2.

INDUSTRIAL APPLICABILITY

It should be apparent that the pump described herein is simple, inexpensive and easily constructed and yet is functional and efficient providing an effective construction for torque compensation.

Other aspects, objects and advantages of this invention can be obtained from a study of the drawings, the disclosure and the appended claims.

It should be apparent that the pump described herein is simple and functional, but yet is effective and be easily manufactured. It should also be understood that the terms "top," "bottom," "inner," "outer," "first," "second," "end," "side," and similar terms as used herein, have reference only to the structure shown in the drawings and are utilized only to facilitate describing the invention. The terms and expressions employed herein have been used as terms of description and not of limitation.

From the foregoing, it will be observed that numerous variations and modifications may be effected without departing from the spirit and scope of the invention. It is to be understood that no limitation with respect to the specific embodiments illustrated herein is intended or should be inferred. While specific embodiments of the invention have been disclosed, one of ordinary skill in the art will recognize that one can modify the dimensions and particulars of the embodiments without straying from the inventive concept.

What is claimed is:

1. A fluid pump for use in high pressure liquid chromatography comprising:

a housing having a drive case and a pump head at one end of the drive case defining an internal pump chamber communicating with an inlet and an outlet;

a first piston supported by said housing for reciprocation along a first axis;

a motor fixed to said housing rotating a shaft;

a cam fixed to said shaft for rotation about a second axis transverse to said first axis, said cam having a peripheral edge intersecting said first axis;

a first spring biasing said first piston along said first axis towards said cam;

said first piston having an outer end with a plunger of lesser diameter than said first piston inward thereof movable in said pump chamber and an inner end engaging said cam edge so that said plunger may be reciprocated in said pump chamber upon rotation of said cam by said motor;

a second piston supported by said housing for reciprocation along said first axis and having inner and outer ends, said cam being disposed between the inner ends of said pistons, said second piston outer end having an outer surface transverse to said first axis open to ambient atmosphere;

a second spring biasing said second piston inner end towards said cam; and, wherein said second spring and atmospheric pressure in combination provide torque compensating force biasing said second piston inward against said cam opposing the inward force of said first piston on said cam.

2. The pump of claim 1 wherein said first spring applies a biasing force of about 3 to 5 pounds and said second spring applies a biasing force generally equal to one half of the maximum force on said first piston.

3. The pump of claim 1 further including an open pump cylinder at the end of said housing opposite said pump head, said second piston extending outward through said housing into said open cylinder and having an outer end with a piston head of greater diameter than said plunger diameter reciprocatable within said open cylinder and defining a second pump chamber between the housing end and piston head communicating with an inlet and an outlet, and said piston head having an outer surface transverse to said first axis open to ambient atmosphere.

4. The pump of claim 3 wherein said first spring applies a biasing force of about 3 to 5 pounds and said second spring applies a biasing force generally equal to one half of the maximum force on said first piston.

5. The pump of claim 3 wherein said first spring applies a biasing force of about 3 to 5 pounds and said second spring applies a biasing force of about 3 to 5 pounds.

6. The pump of claim 3 wherein the diameter of said piston head is 10 to 15 times the diameter of said plunger.

7. The pump of claim 6 wherein the diameter of said plunger diameter is less than 0.4 inch.

8. The pump of claim 3 wherein said cylinder is integrally formed with said housing.

9. The pump of claim 3 further including fluid flow paths between said second pump chamber and its inlet and outlet extending through said housing bottom wall to the periphery of said housing.

10. The pump of claim 1 wherein said cam is generally disc-shaped and said second axis intersects and is perpendicular to said first axis with said peripheral edge rotating through said first axis.

11. A fluid pump for use in high pressure liquid chromatography comprising:

a housing having a drive case and a pump head at one end of the drive case defining an internal pump chamber communicating with an inlet and an outlet;

a first piston supported by said housing for reciprocation along a first axis;

a motor fixed to said housing rotating a shaft;

a cam fixed to said shaft for rotation about a second axis transverse to said first axis, said cam having a peripheral edge intersecting said first axis;

a first spring biasing said first piston along said first axis towards said cam;

said first piston having an outer end with a plunger of lesser diameter than said first piston inward thereof movable in said pump chamber and an inner end engaging said cam edge so that said plunger may be reciprocated in said pump chamber upon rotation of said cam by said motor;

a second piston supported by said housing for reciprocation along said first axis and having inner and outer ends, said cam being disposed between the inner ends of said pistons;

a second spring biasing said second piston inner end towards said cam;

an open pump cylinder at the end of said housing opposite said pump head, said second piston extending outward through said housing into said open cylinder and having an outer end with a piston head of greater diameter than said plunger diameter reciprocatable within said open cylinder and defining a second pump chamber between the housing end and piston head communicating with an inlet and an outlet, said piston head having an outer surface transverse to said first axis open to ambient atmosphere; and, wherein said second spring and atmospheric pressure in combination provide torque compensating force biasing said second piston inward against said cam opposing the inward force of said first piston on said cam.

12. The pump of claim 11 wherein said first spring applies a biasing force of about 3 to 5 pounds and said second spring applies a biasing force generally equal to one half of the maximum force on said first piston.

13. The pump of claim 11 wherein said first spring applies a biasing force of about 3 to 5 pounds and said second spring applies a biasing force of about 3 to 5 pounds.

14. The pump of claim 11 wherein the diameter of said piston head is 10 to 15 times the diameter of said plunger.

15. The pump of claim 11 wherein the diameter of said plunger is less than 0.4 inch.

16. The pump of claim 11 wherein said cylinder is integrally formed with said housing.

17. The pump of claim 11 further including fluid flow paths between said second pump chamber and its inlet and outlet extending through said housing bottom wall to the periphery of said housing.

18. The pump of claim 11 wherein said cam is generally disc-shaped and said second axis intersects and is perpendicular to said first axis with said peripheral edge rotating through said first axis.

19. A fluid pump for use in high pressure liquid chromatography comprising:

a housing having a drive case and a pump head at one end of the drive case defining an internal pump chamber communicating with an inlet and an outlet;

a first piston supported by said housing for reciprocation along a first axis;

a cam within said housing rotatable about a second axis transverse to said first axis and having a peripheral edge intersecting said first axis;

a first spring biasing said first piston inward into contact with said cam;

said first piston having an outer end with a plunger of lesser diameter than said first piston inward thereof and an inner end contacting said cam edge so that said plunger may be reciprocated within said pump chamber upon rotation of said cam;

a second piston supported by said housing for reciprocation along said first axis and having an outer end and an inner end contacting said cam edge, said cam being disposed between the inner ends of said pistons;

a second spring biasing said second piston inward into contact with said cam with a force generally equal to one half of the maximum force of said first piston on said cam; and, wherein said second spring provides torque compensating force biasing said second piston inward against said cam opposing the inward force of said first piston on said cam.

* * * * *